US006572406B2

(12) United States Patent
Guidet

(10) Patent No.: US 6,572,406 B2
(45) Date of Patent: Jun. 3, 2003

(54) ELEMENT FOR COAXIAL ELECTRICAL CONNECTOR AND COAXIAL ELECTRICAL CONNECTOR COMPRISING SAME

(75) Inventor: Olivier Guidet, Grenoble (FR)

(73) Assignee: Radiall, Rosny-Sous-Bois ( * ) Notice: Subject to any disclaimer, the term of this patent is extended or adjusted under 35 U.S.C. 154(b) by 0 days.

(21) Appl. No.: 10/088,252

(22) PCT Filed: Jan. 23, 2001

(86) PCT No.: PCT/FR01/00213

§ 371 (c)(1),
(2), (4) Date: Jun. 26, 2002

(87) PCT Pub. No.: WO01/54234

PCT Pub. Date: Jul. 26, 2001

(65) Prior Publication Data

US 2002/0173200 A1 Nov. 21, 2002

(30) Foreign Application Priority Data

Jan. 24, 2000 (FR) ..... 00 00857

(51) Int. Cl.[7] ..... H01R 9/05
(52) U.S. Cl. ..... 439/578; 439/76.1
(58) Field of Search ..... 439/578–585, 439/63, 76.1, 98, 610

(56) References Cited

U.S. PATENT DOCUMENTS 4,698,906 A * 10/1987 Minar et al.
5,209,669 A * 5/1993 Fuchs ..... 439/59
5,453,019 A * 9/1995 Garver et al. ..... 439/610
5,580,261 A * 12/1996 Meynier ..... 439/578

FOREIGN PATENT DOCUMENTS

FR 2345043 * 10/1977

* cited by examiner

*Primary Examiner*—Gary Paumen
(74) *Attorney, Agent, or Firm*—Schweitzer Cornman Gross & Bondell LLP

(57) ABSTRACT

A coaxial electrical connector portion comprises a central conductor and an outer body (1) forming a ground contact and defining a cylindrical inside cavity. The central conductor is a metallized track (6) made on one face of a printed circuit insert (3), said printed circuit insert also carrying at least one metallized zone made on the face of the insert opposite from its face carrying said track (6) and/or on the face carrying it, said metallized zone(s) being electrically connected to ground and being in contact with the body (1) of said connector portion.

8 Claims, 4 Drawing Sheets

ELEMENT FOR COAXIAL ELECTRICAL CONNECTOR AND COAXIAL ELECTRICAL CONNECTOR COMPRISING SAME

The present invention relates to a coaxial electrical portion and also to a coaxial electrical connector including such a portion, and also performing a switching function.

Numerous types of coaxial connector are already known which enable an electrical line to be connected to another electrical line when two connector portions are engaged one within the other.

Such connectors are used in particular in the field of telecommunications, specifically for connecting portable appliances such as portable telephones to test apparatus, or to an external antenna, or to electronic equipment, in particular when the portable telephone is to be used in a motor vehicle.

The Applicant company has already described such an electrical connector in U.S. Pat. No. 5,580,261, where the connector serves to provide a switching function and comprises a first connector portion having both a central conductor and a ground conductor surrounding the central conductor, being separated therefrom by an insulator, together with a third conductor which is electrically in contact with the central conductor when the connector is in the coupled state; and a second connector portion comprising both a central conductor and an outer ground conductor separated by an insulator, said second connector portion being arranged so that on coupling with said first connector portion, it separates the central conductor and the third conductor of the first connector portion and puts the central conductors of the two connector portions into contact with each other.

That document provides for the major fraction of the length of the third conductor of the first connector portion to be separated from the central conductor of said connector portion by the ground conductor.

In another embodiment described in U.S. Pat. No. 5,453,019, the central conductor and the third conductor of the first connector portion are formed by two conductive springs bearing against each other when the connector is in the uncoupled position, and during coupling of the connector portions the central conductor of the second connector portion bearing against an extension of the insulation provided in said second connector portion then engages between the two conductive springs, thereby moving them apart.

In practice, the first connector portion can be a socket mounted on a printed circuit card and the second connector portion can be a plug mounted at the end of a coaxial cable and suitable for engaging in the socket.

Given the dimensions required by known structures, the socket-forming first connector portion is mounted on the printed circuit card in a "card edge" configuration, i.e. the axis of the socket is parallel to the card.

For reasons of accessibility, it is desirable to be able to mount the socket-forming connector portion perpendicularly to the printed circuit card, as is the case for the coaxial connector described in JP-A-125 410, thereby reducing the height available for the connector portion in the article (such as the portable telephone) in which it is mounted.

In practice, known coaxial electrical connectors cannot be miniaturized as much as is desired while still being of low cost design, in particular because of the structure of the plug-forming second connector portion, in particular given the arrangement of its central conductor and the insulation which holds the central conductor. As a result, known coaxial connectors have a complementary connector portion forming a socket of size that is relatively large, in particular in the axial direction.

The present invention proposes making a coaxial electrical connector portion that can be used in particular in a coaxial electrical connector that also, performs a switching function, in a manner that enables a high degree of miniaturization to be achieved while being low cost in design, by providing a novel embodiment of the central contact. In addition, the connector portion of the invention, when used with a switching complementary connector portion, ensures excellent radio frequency (RF) isolation between the two electrical lines to be switched.

The present invention provides a coaxial electrical connector portion comprising a central conductor and an outer body forming a ground contact, made of a conductive material or coated in a conductive material, defining a cylindrical inside cavity, the connector portion being characterized by the fact that the central conductor is a metallized track made on one face of a printed circuit insert, the insert preferably being in the form of an elongate rectangle and held inside said body by being disposed diametrically across said cavity, the printed circuit insert including, in addition to said metallized track forming the central contact, at least one metallized zone made on the face of the insert opposite from its face carrying said track and/or on the face carrying said track, the metallized zone(s) being electrically connected to ground and being in contact with the body of said connector portion.

The connector portion of the invention thus has two electromagnetically isolated cavities, one conveying the signal and the other performing the function of providing isolation relative to electromagnetic radiation.

The track forming the central contact in the invention itself constitutes a microwave transmission line relative to the metallized zone(s) in contact with ground.

The printed circuit insert is preferably held inside the body by being engaged in diametrically opposite grooves of the inside wall of an extension of tapering section of said body.

The connector portion can be straight or angled in shape.

The present invention also provides a coaxial electrical connector enabling a switching function to be performed, the connector comprising a first connector portion comprising two central conductive springs bearing against each other in the uncoupled position of the connector, and an outer ground conductor surrounding said springs and being separated therefrom by insulation, the connector being characterized by the fact that its second connector portion comprises a connector portion as defined above, making it possible, on coupling with the first connector portion, to-separate said springs thereof from each other, making electrical contact with one of said springs constituting the central conductor of the first connector portion and the conductive metallized track forming the central conductor of the second connector portion.

Other advantages and characteristics of the present invention will appear on reading the following description of non-limiting embodiments, given with reference to the accompanying drawings, in which.

Figure 1:
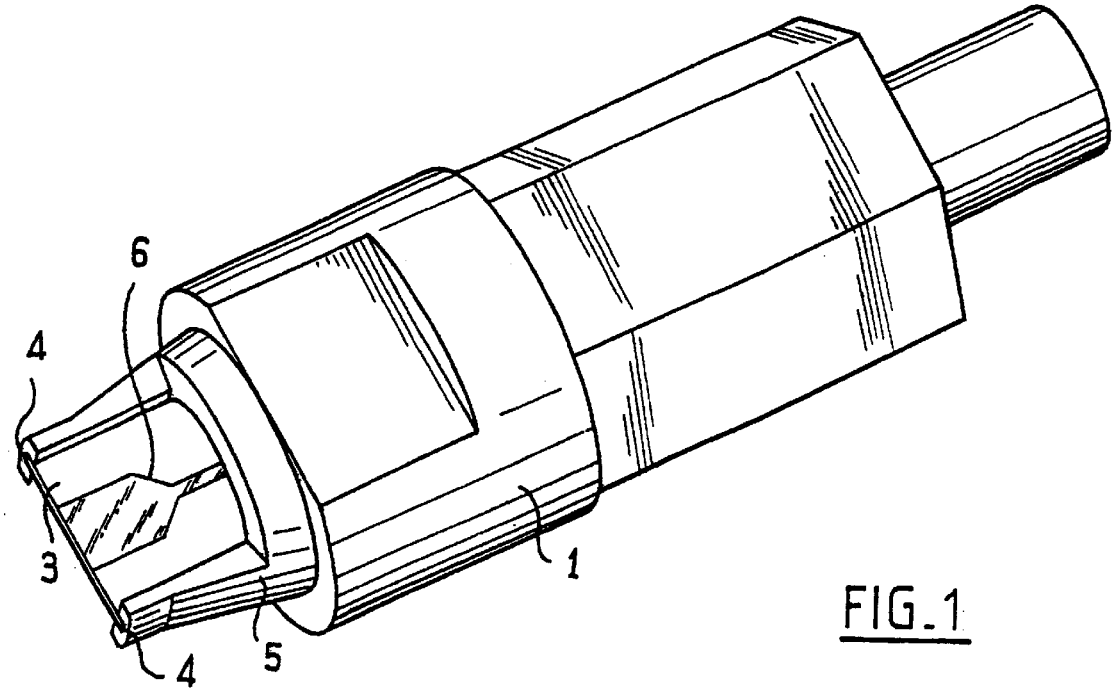
FIG. 1 is a diagrammatic view of a coaxial connector portion of the invention arranged as a plug installed at the end of a coaxial cable.

The coaxial electrical connector portion of the invention shown in FIG. 1 comprises an outer body 1 forming a ground contact and defining a cylindrical inside cavity 2 containing a printed circuit insert 3 in the form of an elongate rectangle.

As can be seen in FIG. 1, the printed circuit insert 3 is held by being retained at its end in two diametrically opposite grooves 4 made in the inside wall of an extension 5 of the body, said extension being of tapering cylindrical and conical shape, the end edge of the insert 3 being level with the end face of the extension 5.

On one of its faces, the insert carries a metallized track 6 extending substantially axially inside the connector portion once the insert 3 has been installed therein, said track 6 extending from one end to the other or substantially from one end to the other of said insert. Variants of this metallized track constituting the central conductor of the connector portion in which it is mounted are described below with reference to FIGS. 4 to 6.

Figure 3:
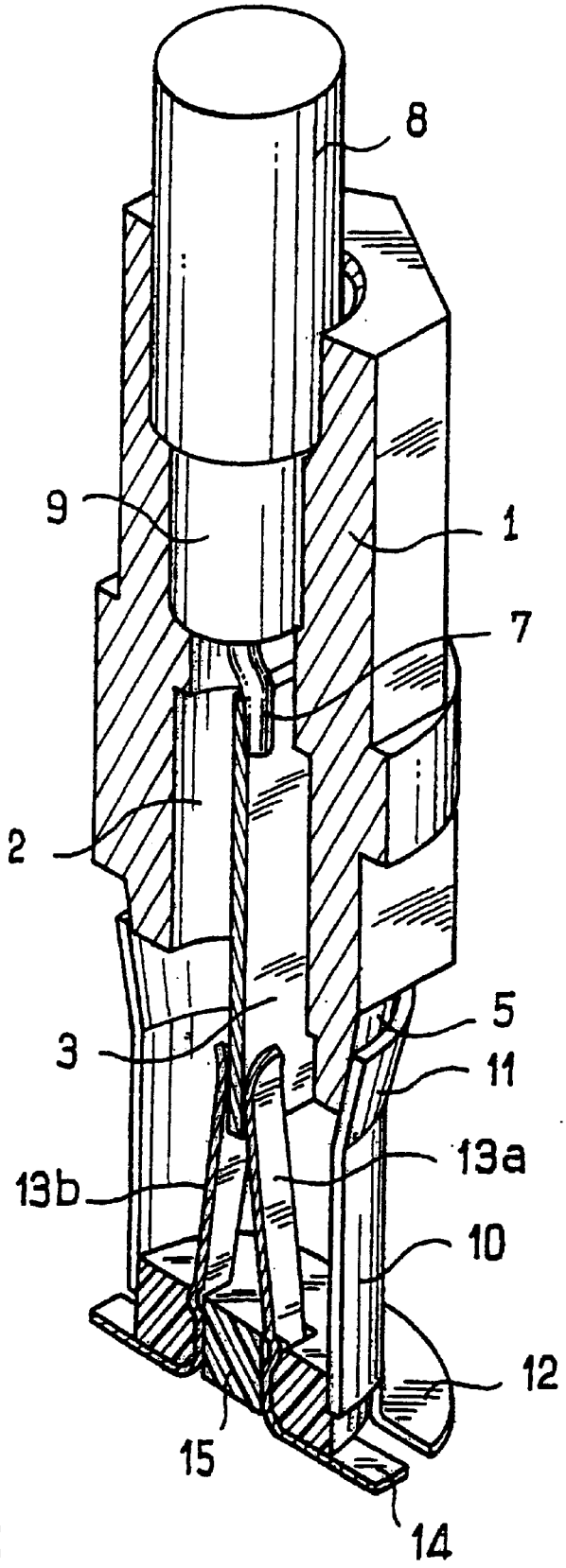
FIG. 3 is a perspective view partially in section showing the connector portion of FIGS. 1 and 2 in the assembled position.

At its end opposite from the end shown in FIG. 1, the track 6 of the insert is for putting into contact with a conductor of a connected item, and in particular as shown in FIG. 3, the central conductor 7 of a coaxial cable having an outer ground conductor 8 separated from its central conductor 7 by insulation 9.

The body 1 of the connector portion is arranged to receive the coaxial cable in its central cavity 2, as can be seen in FIG. 3.

It should be observed in FIG. 3 that for greater clarity the metallized track of the printed circuit insert 3 is not shown.

Figure 2:
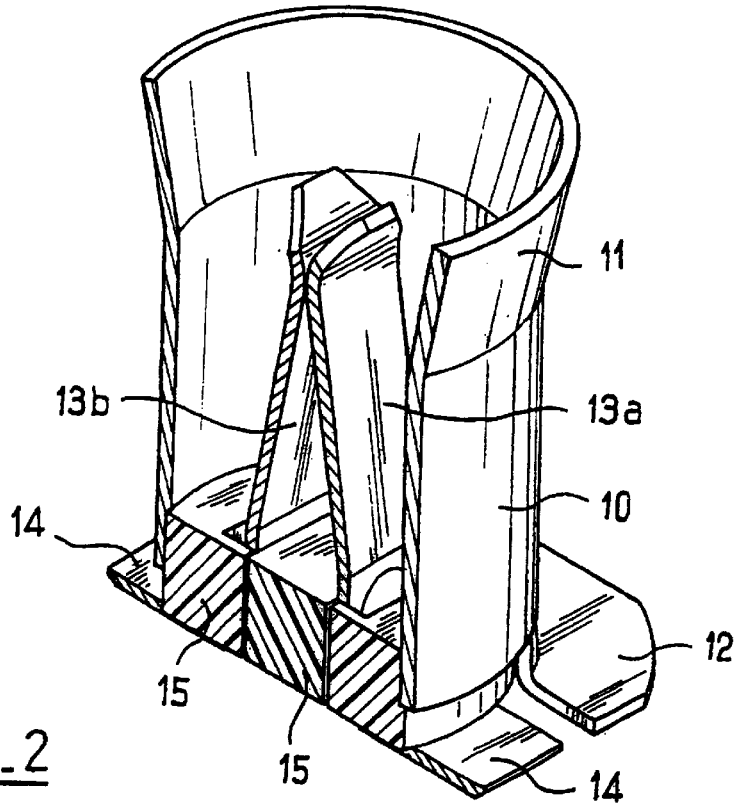
FIG. 2 is a perspective view partially in section showing a connector portion complementary to that of FIG. 1.

The connector portion shown in FIG. 1 can be used in connection with a complementary connector portion that forms a socket, as shown in FIG. 2, so as to constitute a coaxial electrical connector that also enables a switching function to be performed.

The socket shown in FIG. 2 and which can be seen in the assembled position in FIG. 3 comprises a cylindrical body 10 having a flared top portion 11 forming a ground conductor and suitable for being fixed by tabs 12 to a ground line of a printed circuit card (not shown) with the socket being mounted perpendicularly to the card.

The socket has two conductive metal springs 13*a* and 13*b* which press against each other in the rest position, as shown in FIG. 2, which springs are connected by tabs 14 to tracks of the printed circuit card (not shown), these springs 13*a* and 13*b* being separated from the body 10 of the socket by insulating bodies 15.

When it is desired to perform switching, the two connector portions are assembled together with the spring 13*a* then coming into contact with the track 6 that forms the central contact, while the spring 13*b* comes into contact with the opposite face of the printed circuit insert 3 which, as described below with reference to FIGS. 5 and 7, can present a face that is metallized or that is not metallized.

The track 6 of the insert 3 serves in the switched position as shown in FIG. 3 to provide electrical continuity between the spring 13*a* and the central conductor 7 of the coaxial cable.

Once the connector portion fitted with the printed circuit insert 3 has been withdrawn from the socket, the springs 13*a* and 13*b* return to pressing against each other.

The body 1 forming a ground contact can be made out of a conductive material, or where appropriate, out of a non-conductive material that is metallized in inside and outside zones where, in the assembled position, it is brought into contact respectively with the ground conductor 8 of the coaxial cable and with the body 10, 11 of the socket, and also into contact with metallized zones forming the ground contact of the insert as described in greater detail below.

Figure 4:
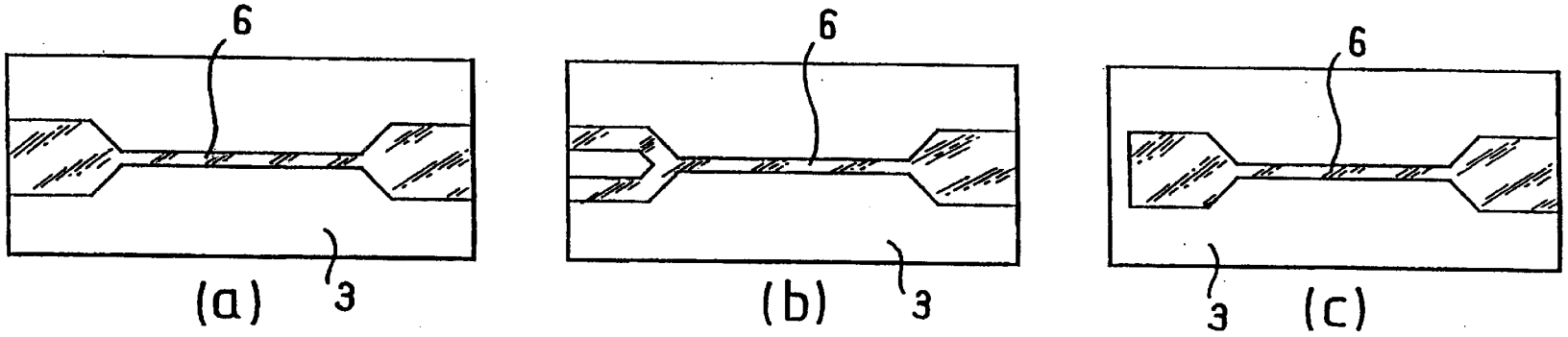
FIGS. 4 to 7 show variant printed circuit inserts that can be used in the FIG. 1 connector portion.
Figure 5:
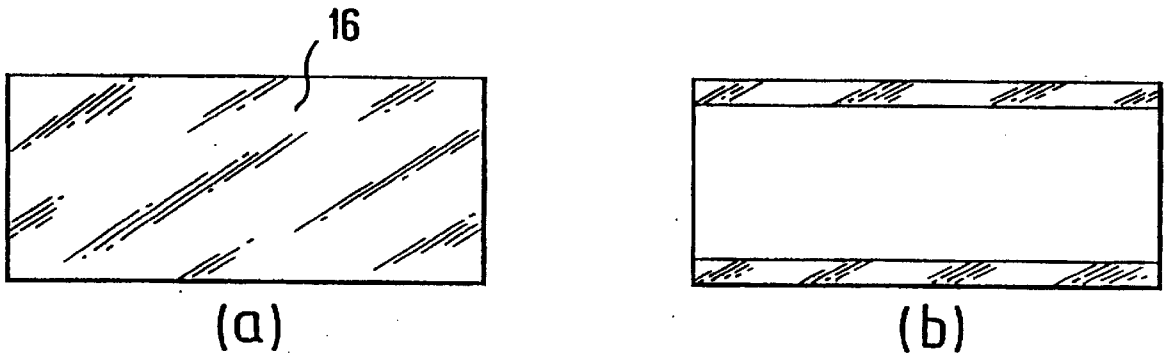

Reference is now made to FIGS. 4 and 5 which show variant embodiments of the metallization on the two respective faces of the printed circuit insert 3.

FIGS. 4 and 5 correspond to a "stripline" type embodiment.

FIGS. 4*a*, 4*b*, and 4*c* show variants of the metallized track 6 that forms the central conductor of the connector portion shown in FIG. 1.

In the three embodiments shown, the track has enlarged end portions and is thus generally dumbbell shaped when seen in plan view. In the embodiment of FIG. 4*a*, the track 6 extends to both ends of the insert.

The flared end portion has the advantage of providing electrical contact with the signal spring 13*a* of the complementary connector portion, even in the event of poor positioning. It has been found that after a large number of operations, the springs of the socket can become worn in spite of the coatings used. Under such circumstances, it can become difficult to obtain reliable contact in the non-switched position as shown in FIG. 2.

To remedy this problem, it is possible for the track 6 to be embodied as shown in FIG. 4*b* where the flared end portion of the track 6 is subdivided into two tongues separated by a non-metallized zone. Contact continues to be made on one or other of the metallized tongues but the central zone of the spring does not become worn by rubbing against a metallized track of the printed circuit insert. This ensures that the springs of the socket retain respective zones that are subjected to very little wear. In the non-switched position, these non-worn zones come into contact with each other and thus provide good electrical contact. In the switched position, it is the worn zones of the spring that come into contact with the metallized tongues of the insert. This configuration increases the lifetime of the connector in a manner that can be quite significant.

It is also possible to implement the embodiment shown in FIG. 4*c* where the flared portion of the metallized track 6 is set back a little from the end edge of the insert. This embodiment also serves to modify rubbing conditions and thus wear.

The opposite face of the insert, two embodiments of which are shown in FIGS. 5*a* and 5*b*, is intended to come into contact with the opposite spring 13*b* of the socket.

Advantageously, this face of the printed circuit insert is metallized over its entire surface area, the metallization 16 being apparent over its entire surface as shown in FIG. 5*a* or being covered in its central portion by an insulating varnish as can be seen in FIG. 5*b*, thus making it possible to keep the spring 13*b* of the socket isolated. This extra thickness imparted by the insulating varnish provides better insulation between the electrical paths.

Figure 6:
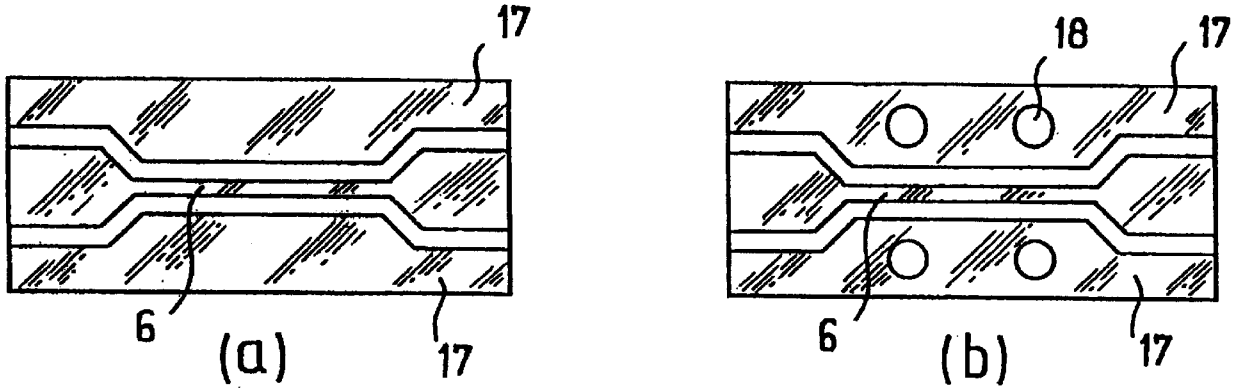
Figure 7:
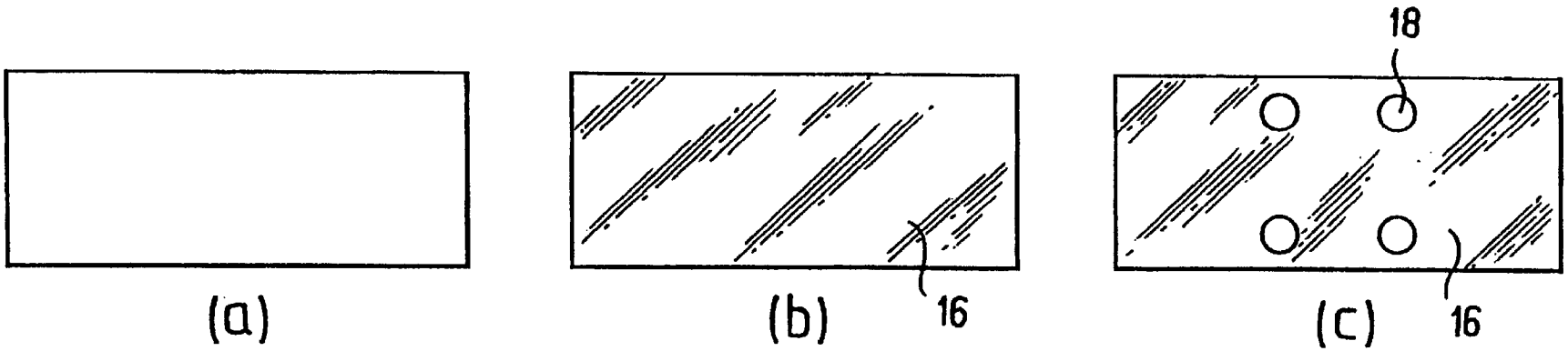

FIGS. 6 and 7 show variants of the "coplanar" line type.

The face of the insert that carries the metallized track 6 that forms the central contact includes metallization 17 that transforms the microwave line into a coplanar type line.

The ground plane on the opposite face formed by metallization 16 can be kept in the coated state, where appropriate, using an insulating varnish as in the case of FIG. 5*b* (FIGS. 7*b* and 7*c*) or can even be omitted (FIG. 7*a*) without excessively degrading performance. In an embodiment of the printed circuit insert that had faces of the kinds shown in FIGS. 6*b* and 7*c*, through holes 18 with plated walls (there being four such holes in the example shown) are provided so as to put the ground metallization on the two opposite faces of the printed circuit insert 3 into connection.

Because of the way the plug-forming connector portion is designed, as shown in FIG. 1, the present invention makes it possible to manufacture complementary connector portions in the form of a socket that is very simple and that can be obtained by mass-production means, it being possible to obtain the body by deep stamping and the springs by cutting out, for example.

When the connector portion of the invention, as shown in FIG. 1, is used with a connector portion such as a socket, as shown in FIG. 2, to provide a switching function, then excellent isolation is obtained between the paths in the switched state, the isolation being provided by the body of the printed circuit insert 3 which is provided with the metallization. The use of such a thin printed circuit insert as a support for the metallized track forming the central contact makes it possible to reduce the size of the connector, and in particular the size of the connector portion that forms the socket, specifically by reducing the length of its springs, which can be short since they are subjected to little bending during interfitting of the portions. Long-term mechanical endurance is obtained, and wear takes place on the springs in zones that are different for the switched position and for the non-switched position, as explained above.

Although the invention is described with reference to particular embodiments, it is clear that it is not limited in any way thereto and that various modifications and variants could be applied thereto without thereby going beyond its ambit or its spirit.

What is claimed is:

1. A coaxial electrical connector portion comprising a central conductor and an outer body (1) forming a ground contact and defining a cylindrical inside cavity (2), the connector portion being characterized by the fact that the central conductor is a metallized track (6) made on one face of a printed circuit insert (3), said printed circuit insert further comprising at least one metallized zone (16, 17) made on the face of the insert opposite to the face carrying said track (6) and/or on the face carrying it, said metallized zone(s) (16, 17) being electrically connected to ground and being in contact with the body (1) of said connector portion.

2. A coaxial electrical connector portion according to claim 1, characterized by the fact that the metallized track (6) forming the central conductor has flared end portions.

3. A coaxial electrical connector portion according to claim 1, characterized by the fact that the printed circuit insert (3) is in the form of an elongate rectangle and is held in said body (1) by being placed diametrically cross the cylindrical cavity (2) thereof.

4. A coaxial electrical connector portion according to claim 1, characterized by the fact that the printed circuit insert (3) is held in the body (1) by being engaged in diametrically opposite grooves in the inside wall of an extension (5) of tapering section of said body.

5. A coaxial electrical connector enabling a switching function to be performed, the connector comprising a first connector portion comprising two central conductive springs **(13*a*, 13*b*) bearing against each other in the uncoupled position of the connector, and an outer ground conductor (10, 11) surrounding said springs and being separated therefrom by insulation (15), the connector being characterized by the fact that its second connector portion comprises a connector portion according to any preceding claim, making it possible, on coupling with the first connector portion, to separate said springs thereof from each other, making electrical contact with one of said springs (13*a*) constituting the central conductor of the first connector portion and the conductive metallized track (6)** forming the central conductor of the second connector portion.

6. A coaxial electrical connector according to claim 1, characterized by the fact that said connector portion is a socket suitable for being fixed perpendicularly to a printed circuit card.

7. A coaxial electrical connector according to claim 6, characterized by the fact that the socket has a cylindrical body (10) forming a ground conductor and provided with tabs (12) for fixing to a ground line of the printed circuit card.

8. A coaxial electrical connector according to claim 6, characterized by the fact that the springs **(13*a*, 13*b*) are separated from the body (10) of the socket by insulating bodies (15) and have respective tabs (14)** for fixing to tracks of the printed circuit card.

* * * * *